US006745604B1

(12) United States Patent
Morales

(10) Patent No.: US 6,745,604 B1
(45) Date of Patent: Jun. 8, 2004

(54) ENAMEL COATED BINDING SURFACE

(75) Inventor: Arianna T. Morales, Royal Oak, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/387,615

(22) Filed: Mar. 13, 2003

(51) Int. Cl.[7] ..... B21D 26/02

(52) U.S. Cl. ..... 72/60; 72/350; 72/453.04; 29/421.1

(58) Field of Search ..... 72/56, 57, 60, 72/63, 350, 351, 453.04; 29/421.1

(56) References Cited

U.S. PATENT DOCUMENTS 2,873,709 A * 2/1959 Celovsky ..... 72/361
3,927,460 A * 12/1975 Harada et al. ..... 72/46
5,372,026 A * 12/1994 Roper ..... 72/60
6,047,583 A 4/2000 Schroth
6,253,588 B1 7/2001 Rashid et al.
6,305,202 B1 10/2001 Kleber

* cited by examiner

*Primary Examiner*—David B. Jones
(74) *Attorney, Agent, or Firm*—Kathryn A. Marra

(57) ABSTRACT

An apparatus for forming a metal piece at an elevated temperature comprises a part having a binding surface configured to hold the metal during forming, wherein the binding surface comprises a porcelain enamel coating. The apparatus may be a superplastic forming process, and the binding surface may have an enamel coated seal bead that cooperates with a second binding surface of a second binding surface to form a seal about a perimeter of a metal sheet that is formed into a desired shape.

28 Claims, 2 Drawing Sheets

ENAMEL COATED BINDING SURFACE

FIELD OF THE INVENTION

The present invention concerns seals for high temperature applications, tools having such seals, and forming processes carried out in sealed cavities.

BACKGROUND OF THE INVENTION

Metal articles are often forming at elevated temperature at which the metal is more ductile. "Quick plastic forming" and "superplastic forming" refer to processes for forming metallic materials such as aluminum alloys of aluminum, magnesium, and titanium at temperatures at which the materials have exceptional ductility. Metal alloys suitable for superplastic forming generally have tensile ductility ranging from 200% to 1000%. For example, certain aluminum alloys such as SP Aluminum Alloy 5083 can be deformed with air at temperatures of about 450 to about 600° C., depending on the specific composition, to take the shape of a die surface inside of one-half of a sealed tool cavity. C. H. Hamilton and A. K. Ghosh, "Superplastic Sheet Forming," *Metals Handbook, Ninth Edition,* Vol. 14, pages 852–868, incorporated herein by reference, provides a background description of practical superplastic metal alloys and SPF processes. The authors describe several superplastic aluminum and titanium alloys that are suitably fine grained for SPF processes.

Stretch forming is one SPF process that is adaptable to forming relatively large sheets of superplastic metal, e.g. superplastic aluminum alloys, into automobile body panels or other large parts. In stretch forming a flat sheet blank is gripped or clamped at its edges by two complementary tool parts that, when closed together, meet around a periphery of an inner, forming volume within which the sheet is held. The tool parts are sealingly closed together and the sheet is heated to its SPF temperature. One of the tool parts has a cavity with inner shaping surface ["die surface"] opposite one face of the sheet. The second tool part, opposite the other face of the sheet, forms a pressure chamber, with the sheet as one wall, to contain the working gas for the forming step. The tool parts and the sheet are maintained at an appropriate forming temperature, for example by using electric resistance heating elements located in press platens or embedded in ceramic or metal pressure plates located between the parts and the platens. The chamber formed by the second tool part is pressurized using a suitable gas such as air or argon. The central, unclasped portion of the heated sheet is forced by the pressure to stretch and plastically deform into conformity with the die surface to make an article of the desired shape. The rate of pressurization is controlled so the strain rates induced in the sheet being deformed are consistent with the required elongation for part forming. Suitable strain rates are usually 0.0001 to 0.01 $s^{-1}$. The part is then cooled and removed from the tool. Vehicle body panels and other articles of complex shape may be formed by this process.

Rashid et al., U.S. Pat. No. 6,253,588, incorporated herein by reference, describes another representative superplastic forming process, quick plastic forming, using a magnesium-containing aluminum alloy having a particular microstructure. The superplastic forming (SPF) process is usually a relatively slow, controlled deformation process that yields complicated products. The quick plastic forming (QPF) process is a variant of SPF in which a higher strain rate allows a part to be formed in a much shorter time. An advantage of SPF and QPF processes is that they often permit the manufacture of large single articles that cannot be made by other processes such as conventional sheet metal stamping. Sometimes a single SPF part can replace an assembly of several parts made from non-SPF materials and processes.

When the periphery of the sheet is held in a fixed position between binding surfaces of the two complementary tool parts (i.e., the edges of the tool parts that contact the sheet) for an SPF process, the binding surfaces grip the sheet in a gas tight seal to allow for pressurization on one side of the sheet. The sheet does not flow over the binding surface as is typical in a conventional deep drawing operation. It is common to use a raised seal bead to grip the periphery of the sheet. For instance, male rectangular cross-section beads may be employed on one tool surface while the opposing binding surface is flat. A typical seal bead has a raised rectangular or trapezoidal cross-section approximately 10–15 millimeters wide and 0.5–1 mm tall. Because the tool parts must be well sealed in the superplastic forming process to achieve the necessary pressure to force the metallic material against the die, it would be desirable have a seal bead that forms as gas-tight of a seal as possible during use of the tool. If the tool is not adequately sealed, the article may not be fully formed. One problem encountered in superplastic forming is poor sealing due to slight misalignment of the tool parts or inadequate clamping pressures. It would thus be desirable to provide a seal bead that can be sealed with less pressure and/or can form a good seal even if the complementary tool parts are slightly misaligned.

Another problem encountered in superplastic forming is sticking of the formed sheet to the tool in the vicinity of the seal bead during part extraction. Because the sheet components are very deformable at the forming temperature, sticking can distort the panel during panel extraction due to uneven forces that may be applied in dislodging the part. Distortion is undesirable when a class A surface or dimensionally accurate part is required. Sticking also excludes effective use of robots for handling the parts during production because the amount of sticking is not predictable and individualized care must be taken in extraction.

The problem is particularly acute with aluminum sheet metal and severely slows the effective removal of an SPF-formed article from the binding portions of the tools. The aluminum sheet sticks primarily on the raised bead binding surface, but also may stick on the opposing flat binding surface. The sticking is due to reaction of the binding surfaces with freshly exposed, unoxidized aluminum at forming temperatures. This unoxidized, reactive aluminum is exposed at the sheet surface as a result of plastic deformation of the aluminum sheet during the clamping process prior to sheet forming. As the die is closed, aluminum is extruded (locally) away from the volume clamped between the bead and the opposing flat tool binding surface. As a result, the protective aluminum oxide film on the aluminum sheet surface is ruptured, and highly reactive aluminum is brought into intimate contact with the tool binding surface. The SPF forming tools are often made of, e.g., P20 steel, ductile cast iron or tool steel. For most such tool materials, local reaction or microwelding occurs to locally bond the aluminum sheet to the tool and cause sticking and tearing during part removal. This sticking problem may be tolerable when low volume production articles can be carefully pried from the tool, but the problem cannot be tolerated when high production rates are required. To adapt SPF to the production of automotive panels, practices must be developed that facilitate fast removal of an SPF-formed article from the forming tools.

One method that has been used to reduce sticking of the article to the toolsurfaces has been to apply a generous amount of a lubricant in the area of contact. This approach is not desirable for a number of reasons. First, applying a lubricant adds expense and preparation time to the forming process. Second, lubrication may need to be reapplied between parts. Additionally, the lubricant must be cleaned from the formed article and in some cases from the forming tool. These drawbacks make lubrication an unattractive solution. Another method that has been used to reduce sticking of the article to the tool has been to use a shallower seal bead to limit sheet deformation, as described by Scroth, U.S. Pat. No. 6,047,583, incorporated herein by reference. This reduces the surface area of unoxidized aluminum from the aluminum sheet that comes in contact with the tool. While this method does lead to less deformation, lubrication of the seal bead area is still needed to avoid deforming the part. Thus, it would be desirable to have a method of preventing a part from sticking to the seal bead that completely eliminates the use of a lubricant to produce a distortion free part.

SUMMARY OF THE INVENTION

The invention provides a tool for forming metal at elevated temperatures that has a binding surface with a porcelain enamel coating for holding the metal during forming. The binding surface contacts a metal sheet, for example, and may form a seal with the sheet. In general, the binding surface works with a complementary opposing binding surface of the tool in holding the metal item, e.g. metal sheet, and the first binding surface and the complementary opposing binding surface may together form a sealed perimeter about a portion of the sheet or other metal article. In one embodiment, a binding surface comprises a seal bead and the seal bead is provided with a porcelain enamel coating.

The invention further provides a method of forming a metal sheet at an elevated temperature in which the metal sheet is held in place by a binding surface of a tool. A binding surface in contact with the metal sheet has a porcelain enamel coating. The metal sheet is formed into a desired shape at an elevated temperature, preferably by a superplastic or quick plastic forming process. In one embodiment of the method, the first binding surface is used with a second, complementary and opposing binding surface, with the first and second binding surfaces together enclosing a portion of the sheet within a cavity of the tool and the binding surfaces defining a perimeter of the cavity. The opposing binding surfaces may form a sealed perimeter during heated forming of the sheet, for example by a superplastic forming process, and the first binding surface may have a seal bead with a porcelain enamel coating layer in contact with the metal sheet.

The enamel coated tool seal bead or other binding surface avoids sticking of the metal parts to the seal bead or binding surface. Further, in the quick plastic forming process or superplastic forming process, the enamel coating avoids problems caused by slight misalignment of the binding surfaces of the opposing tool halves. The enamel coating promotes an excellent seal without extreme clamping pressures. At hot forming temperatures, the porcelain enamel coating is softer than the die material, but still resistant to compressive stresses. Therefore, the porcelain enamel coated seal beads can correct small misalignments between the complementary tools than could uncoated seal beads. Moreover, in the case of a coated binding surface or seal bead, little or no lubricant is needed to avoid sticking. Finally, the enamel coating extends tool life by reducing or avoiding seal bead wear or binding surface wear.

"About" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art through this ordinary meaning, then "about" as used herein indicates a possible variation of up to 5% in the value. All parts and percentages are by weight if not specifically indicated to be otherwise. "A" and "an" are used to mean "at least one;" of the item is present; a plurality of such items may be present, when possible.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
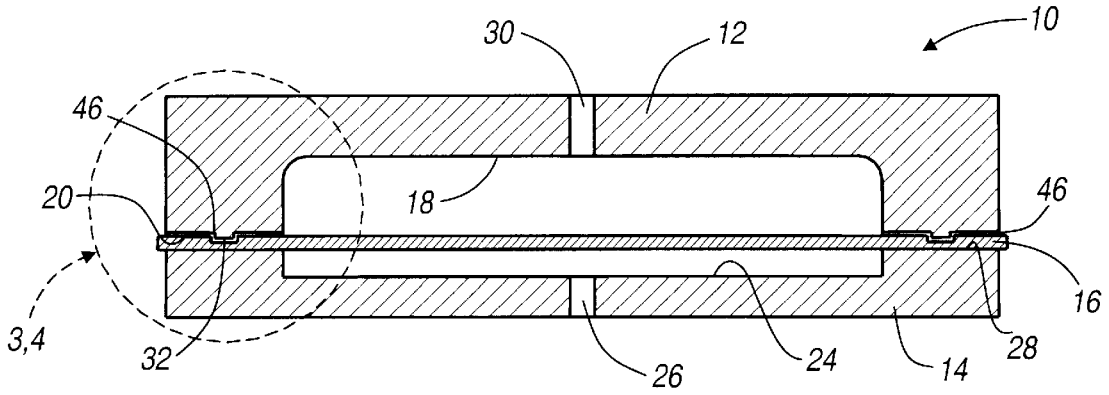
FIG. 1 is a cross-sectional view of a pair of complementary SPF forming tools engaging a superplastic formable metal sheet.

The following description of the preferred embodiment(s) is merely exemplary in nature and is in no way intended to limit the invention, its application, or uses.

The invention provides a tool for forming metal at elevated temperatures, the tool including a binding surface having a porcelain enamel coating layer. The porcelain enamel composition is generally a borosilicate glass prepared from a combination comprising quartz ($SiO_2$), borax (anhydrous formula $Na_2B_4O_7$), boric acid ($H_3BO_3$), potassium nitrate ($KNO_3$), sodium silicofluoride ($Na_2SiF_6$), and manganese dioxide ($MnO_2$), and optionally further comprising titanium dioxide ($TiO_2$), antimony oxide ($Sb_2O_3$), cobalt oxide [cobaltous oxide (CoO), cobalto-cobaltic oxide ($CO_3O_4$) and/or cobaltic oxide ($CO_2O_3$)] and/or barium oxide (BaO).

The porcelain enamel coating is generally fused to the surface of the seal bead of a tool by depositing a slurry having an appropriate composition on the binding surface of the tool and then firing the deposited layer at an elevated temperature. Preferred borosilicate coatings are highly complex in their formulation, with physical and mechanical properties that are determined principally by their composition. In turn, the coating composition must be carefully selected and evaluated to ensure compatibility with the tool binding edge substrate, the manner in which the coating is deposited, and the service conditions that the coating must withstand.

The porcelain composition employed by the present invention is preferably formed by firing a layer of slurry composition containing quartz ($SiO_2$), borax (anhydrous formula of $Na_2B_4O_7$), boric acid ($H_3BO_3$), potassium nitrate ($KNO_3$), sodium silicofluoride ($Na_2SiF_6$), and manganese dioxide ($MnO_2$), and optionally containing titanium dioxide ($TiO_2$), antimony oxide ($Sb_2O_3$), cobalt oxide [cobaltous oxide (CoO), cobalto-cobaltic oxide ($CO_3O_4$) and/or cobaltic oxide ($Co_2O_3$)] and/or barium oxide (BaO). Suitable ranges for the pre-fired constituents of the coating composition are about 39 to about 52 weight percent quartz, about 15 to about 24 weight percent dehydrated borax, about 6 to about 12 weight percent boric acid, about 5 to about 8 weight percent potassium nitrate, about 3 to about 6 weight percent sodium silicofluoride, about 3 to about 12 weight percent manganese dioxide, and optionally one or more of these components: up to about 15 weight percent titanium dioxide, up to about 3 weight percent antimony oxide, up to about 1 weight percent cobalt oxide, and up to about 1 weight percent barium oxide. The dry constituents are mixed with water to form an aqueous dispersion of the dry constituents as a slurry, in accordance with known practices. The slurry can then be deposited, e.g., by air or electrostatic liquid spray, on iron and steel binding surface substrates and fired at about 750° C. to 900° C. to yield a coating. A preferred coating thickness is about 25 to 150 micrometers.

The final composition of the coating will depend in part on the firing conditions, but will include the above-noted dry constituents of the slurry with the exception of boric oxide ($B_2O_3$), which is produced during firing from the boric acid component of the slurry. Suitable constituent ranges for the final coating are about 39 to about 52 weight percent quartz, about 15 to about 24 weight percent borax (based on the anhydrous formula), about 7 to about 12 weight percent boric oxide, about 5 to about 12 weight percent potassium nitrate, about 3 to about 8 weight percent sodium silicofluoride, about 3 to about 12 weight percent manganese dioxide, and optionally one or more of: up to about 12 weight percent titanium dioxide, up to about 8 weight percent antimony oxide, up to about 1 weight percent cobalt oxide, and up to about 1 weight percent barium oxide.

The tool for forming metal at elevated temperatures that has a binding surface with a porcelain enamel coating for holding the metal during forming may have a complementary and opposing second binding surface. At least one binding surface has a porcelain enamel coating, but both of the binding surfaces may have a porcelain enamel coating. In a preferred embodiment, the first binding surface and the second binding surface together form a sealed perimeter about a portion of the sheet or other metal article during forming. In one embodiment, a binding surface comprises a seal bead and the seal bead is provided with the porcelain enamel coating.

The metal sheet or other metal article is held in place during hot forming by the binding surface of the tool having the porcelain enamel coating. The metal sheet is formed into a desired shape at an elevated temperature, preferably by a superplastic or quick plastic forming process. In superplastic or quick plastic forming, the first binding surface is used with the second, complementary and opposing binding surface, with the first and second binding surfaces together enclosing a portion of the sheet within a cavity of the tool and the binding surfaces defining a perimeter of the cavity. The opposing binding surfaces form a sealed perimeter during the superplastic forming process. Generally, the first binding surface has a seal bead with a porcelain enamel coating layer in contact with the metal sheet. The tool parts having the binding surfaces are sealingly closed together and the sheet is heated to its SPF or QPF temperature. One of the tool parts has a cavity with inner die surface opposite one face of the sheet. The second tool part, opposite the other face of the sheet, forms a pressure chamber, with the sheet as one wall, to contain the working gas for the forming step. The tool parts and the sheet are maintained at an appropriate forming temperature, for example by using electric resistance heating elements located in press platens or embedded in ceramic or metal pressure plates located between the parts and the platens. The chamber formed by the second tool part is pressurized using a suitable gas such as air or argon. The central, unclasped portion of the heated sheet is forced by the pressure to stretch and plastically deform into conformity with the die surface to make an article of the desired shape. The rate of pressurization is controlled so the strain rates induced in the sheet being deformed are consistent with the required elongation for part forming. Suitable strain rates are usually 0.0001 to 0.01 $s^{-1}$ or more, with the higher strain rates being obtainable by using the QPF process. The part is then cooled and removed from the mold. Vehicle body panels and other articles of complex shape may be formed by this process.

The melting point of the enamel should be significantly higher than the maximum processing temperature at which the metal will be formed. The porcelain enamel preferably has a softening point of about the maximum processing temperature, e.g. the SPF temperature of the metal sheet, at which the coated surface will be used. At this maximum processing temperature, the enamel softens slightly to allow a tighter seal between the opposing sealing surfaces. The softening also avoids problems of slight misalignment by allowing a small amount of conformance to take place at the point of contact of the opposing sealing surfaces. The enamel softening point is preferably at or slightly above, the maximum processing temperature. By "slightly above" is meant up to about 50 to 100° C. above the maximum processing temperature. Thus, the composition of the enamel is chosen to be suitable for the particular processing temperatures at which it will be used. The coating layer should maintain its physical integrity while preferably softening slightly to provide optimum sealing between the opposing sealing surfaces. Particular composition may be chosen by reference t o published literature showing melting point and softening point information for porcelain enamel compositions. The porcelain enamel should also be selected to have good adhesion to the metal surfaces it covers. A typical material for tools for thermal forming, such as tools for SPF processes, is P20 steel. When the enamel has a thermal expansion coefficient substantially matching the substrate to which it is applied the possibility of spalling, flaking, or breakage during use is minimized.

A preferred coating composition is a mixture of about 46.5 weight percent of quartz, about 21 weight percent of borax (based on its anhydrous formula $Na_2B_4O_7$), about 7.5 weight percent of boric acid, about 6 weight percent of potassium nitrate, about 5 weight percent of sodium silicofluoride, about 11.5 weight percent of manganese dioxide, and about 2.5 weight percent of antimony oxide. The coating mixture is applied, for example by spraying as an aqueous slurry of comminuted frits, to the seal bead area of the tool and fused at an appropriate temperature, e.g. 880° C., to form a continuous porcelain-enameled surface.

The porcelain enamel coating can be applied to a roughened surface of the tool binding surface and/or sealing surface, for example to a seal bead of a binding surface of an SPF tool. The porcelain enamel coating preferably has a thickness of from about 25 to about 150 microns. A minimum thickness of about 25 microns, preferably about 40 microns, is preferred to avoid coating failure or breakdown during use of the tool. Coating thicknesses above about 150 microns, more preferably about 80 microns, are not preferred because of the increased tendency toward spalling due to stress build up in the coating layer during deformation. The coating thickness is preferably from about 40 to about 80 microns.

Figure 2:
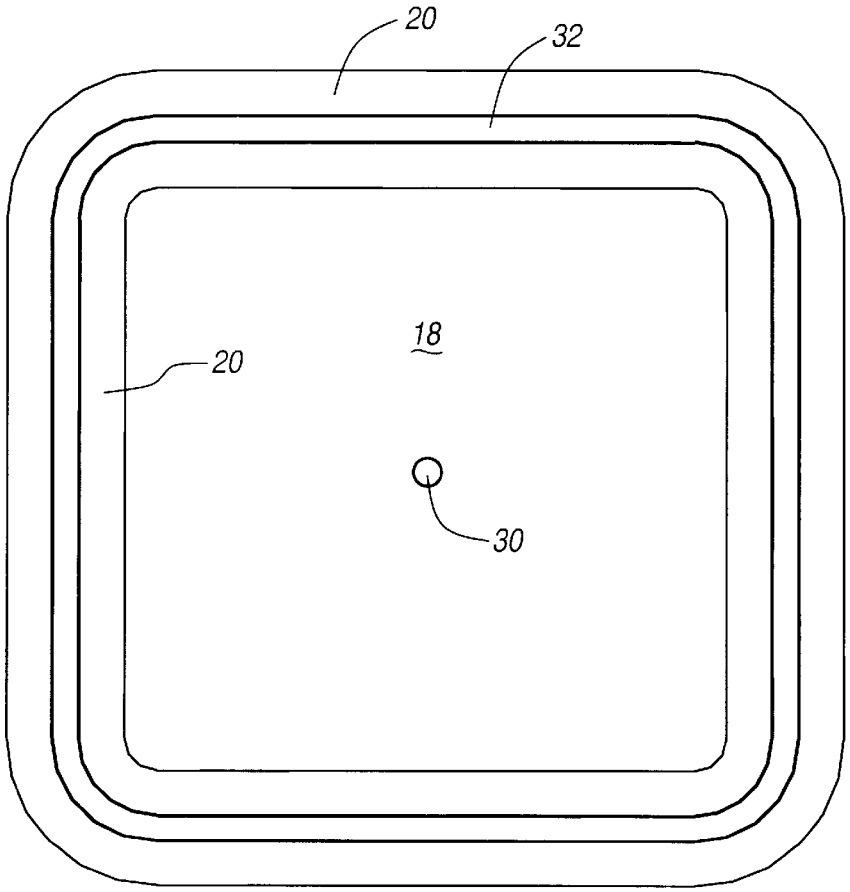
FIG. 2 is a plan view of the upper tool shown in FIG. 1.

The invention will be illustrated with reference to the preferred SPF process in the context of the stretch forming of a shallow pan from a superplastic aluminum alloy sheet. A curved automotive body panel or other large shaped metal part of relatively thin cross-section may be formed analogously. An SPF stretch forming process typically employs two complementary tool halves that sealingly engage the periphery of the sheet workpiece to be formed as illustrated in FIG. 1 and FIG. 2. Complementary tool set 10 includes a stretch forming die or tool half 12 and cooperating tool half 14. The material to be formed is a sheet 16 of aluminum alloy that is of a composition and processing history such that it is susceptible to superplastic forming. An example of such a material is Aluminum Alloy 5083. This alloy has a nominal composition, by weight, of 4 to 4.9 percent magnesium, 0.4 to 1 percent manganese, 0.05 to 0.25 percent chromium, up to about 0.1 percent copper, and the balance aluminum. The cold rolled sheet is processed for superplastic forming so that it has a fine, stable grain structure of about 10 micrometers grain size.

Sheet 16 is suitably about 1.5 mm thick and is generally a square of sufficient size to form the desired pan. The forming tool half 12 as seen in the FIG. 1 has a part-forming cavity surface 18 that has been cast and machined into the tool body. Forming surface 18 defines the bottom, sides and lip of the pan structure. The tool body is suitably formed of P20 steel, ductile cast iron or tool steel. At the perimeter of the square-forming surface 18 is the binding surface 20 portion of tool 12. The binding surface 20 is preferably flat except for the seal bead 22. In other words, the major portion of the binding surface 20 is flat and lies against the periphery of the aluminum sheet 16. Within the area of the binding surface 20 is a seal bead 32 that extends in a square curvilinear path around the entire binding surface portion of the tool. The seal bead may alternatively follow non-planar features of complex parts in the tool. The profile of the seal bead may remain the same, but that profile may follow a non-linear periphery of the tool half 12.

Cooperating tool half 14 is also generally of a shape complementary to tool half 12, so that the peripheries of the two tool halves may close against one another. In the embodiment illustrated in FIGS. 1 and 2, tool half 12 has a square periphery and has a cavity-defining surface 24 into which a pressurized gas such as air or argon may be introduced through opening 26 to stretch form sheet 16 into conformation with forming surface 18 of tool 12. The entire peripheral binding surface 28 of tool half 14 is flat and lies against the periphery of sheet 16.

In the practice of the stretch forming process, the aluminum sheet 16 is heated to a suitable superplastic forming temperature, for example, 400° C. to 550° C., and is placed between the binding surface portion of forming tool 12 and complementary tool 14 when they are spaced apart in a tool open position. When the tools are closed as seen in FIG. 1, the binding portions engage the edges or periphery of the sheet. In this arrangement, in order to form the sheet, a high pressure gas such as air is introduced through opening 26 into the cavity 24 behind the sheet. The high pressure gas, suitably at a pressure of about 100 psi, forces the portion of the sheet 16 within the binding portions of the tools upward as seen in FIG. 1 into contact with the forming surface 18 of tool 12. As the sheet is being stretched and expanded against the forming surface, gas within that chamber is expelled through opening 30. Opening 30 acts as a vent holes. The vent holes used for SPF and QPF tools are usually very small (about 4 mm radius) and are usually designed to be located in non critical areas of the part or where they can be masked by added features, like fascias, etc. It is apparent that in order to effectively carry out this process, a gas tight seal must be provided at the periphery of the aluminum sheet so that gas does not leak out over the surface of the sheet between the binding portions of the forming tools.

Figure 3:
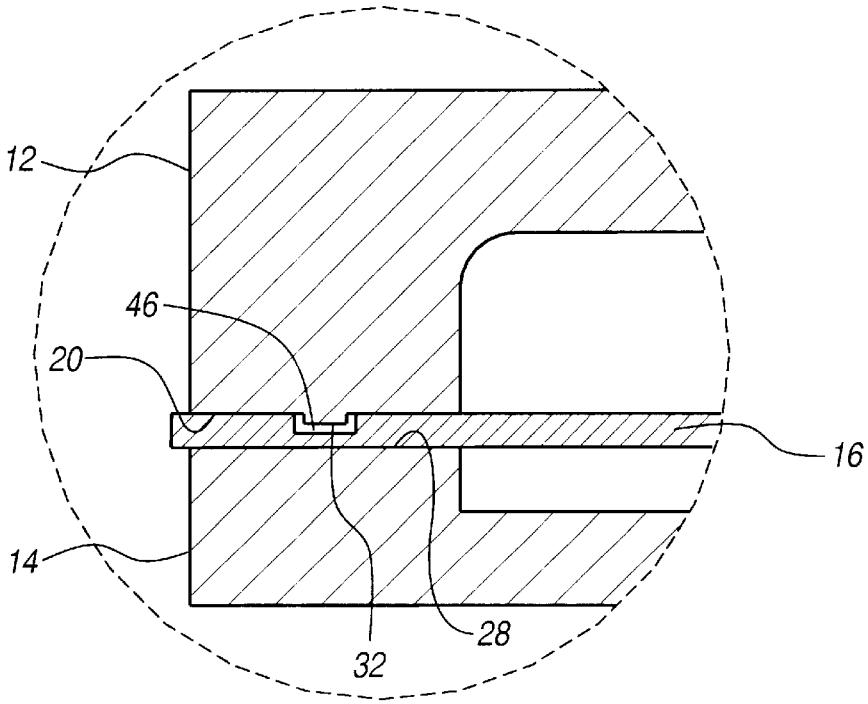
FIG. 3 is an enlarged view of the binder surface sections of the tool shown in FIG. 1.

FIG. 3 provides an enlarged view of the binder surface sections of the tool shown in FIG. 1. A rectangular sealing bead 32 as illustrated in FIG. 3 is provided in the binding portion 20 of the tool half 12. This rectangular bead extends around the periphery of a sheet to be formed. The binding surface 28 of the opposite tool half 14 is flat (as shown) or machined with a complementary recess of rectangular cross section. The porcelain enamel coating 46 is preferably continuous on the seal bead 32 surfaces of the tool half 12. The composition of the coating is formulated to be abrasion-, heat-, and corrosion-resistant and inhibit the sheet 16 from adhering to the seal bead 32. The material of the tool half 12 preferably has a low free carbon content in order to reduce the likelihood of blistering and poor adhesion of the coating to the tool. For this purpose, low carbon steels are suitable for the tool half 12, though other materials having a low free carbon content could be used, such as steels with about 0.3 wt. % titanium and about 0.15 wt. % silicon to maintain free carbon at very low levels.

Figure 4:
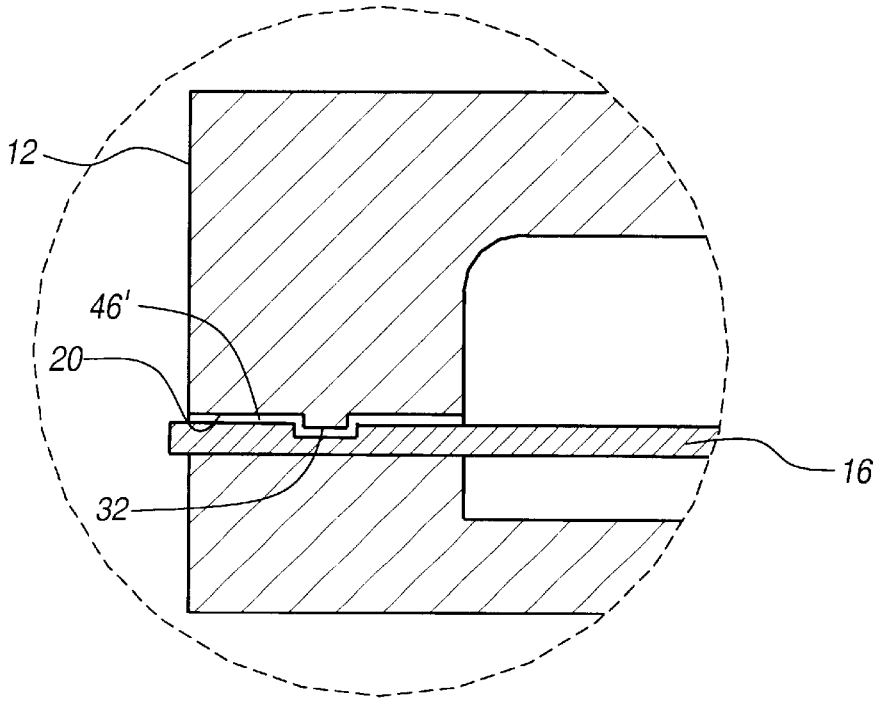
FIG. 4 is an alternate view of binder surface sections of the tool shown in FIG. 1.

FIG. 4 shows an alternative embodiment of binding surface 20 of tool half 12 and binding surface 28 of tool half 14. In FIG. 4, the porcelain enamel coating 46' covers not only the edges of seal bead 32 but also the rest of binding surface 20 of tool half 12. The coating may alternatively cover the seal bead surfaces and only a part or parts of the rest of binding surface 20. A porcelain enamel coating (not shown) could also be formed on part or all of binding surface 28 of tool half 14.

In a preferred embodiment, large AA5083-type aluminum-magnesium alloy sheet stock may be formed into a complex three-dimensional shape with high elongation regions, like an SPF-formed part, at much higher production rates than those now achieved by SPF practices. The magnesium-containing, aluminum sheet is heated to a forming temperature in the range of about 400° C. to 510° C. (750° F. to 950° F.). The forming may often be conducted at a temperature of 460° C. or lower. The heated sheet is stretched against a forming tool and into conformance with the forming surface of the tool by air or gas pressure against the back surface of the sheet. The fluid pressure is preferably increased continuously or stepwise from 0 psi gage at initial pressurization to a final pressure of about 250 to 500 psi (gage pressure, i.e., above ambient pressure) or higher. During the first several seconds up to about, e.g., one minute of increasing pressure application, the sheet accommodates itself on the tool surface. After this initial period of pressurization to initiate stretching of the sheet, the pressure can then be increased at an even faster rate. While the pressure is still relatively low, e.g., of the order of 5 to 10 psi, the hot metal is stretched and brought into initial contact with the forming surface. At this time, generally less than one minute into the forming, the sheet accommodates itself on the tool, particularly at entry radii into pockets and flanges. The pressure can then be raised at an increasing rate. As the pressure is further continuously raised at a controlled and normally increasing rate to a final level, typically in the range of 250 to 500 psi, the rate of stretching increases and more of the sheet is stretched against the shaping surface of the tool. Continued pressure stretches the sheet into full conformance with the tool surface. In this quick stretch forming of many articles, such as automobile body panels, the total forming time at such temperatures and working fluid pressures is surprisingly low, e.g., about one to about 12 minutes per part, depending upon the size and complexity of the panel to be formed.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. An apparatus for forming a metal piece at an elevated temperature, comprising a part having a binding surface configured to hold the metal piece during forming, wherein the binding surface comprises a porcelain enamel coating.

2. An apparatus according to claim 1, further comprising a second part having a second binding surface that is opposite of the first binding surface, wherein the first and second binding surfaces operate together to hold the metal piece.

3. An apparatus according to claim 1, wherein the metal piece is a metal sheet.

4. An apparatus according to claim 3, wherein the first and second binding surfaces operate together to form a sealed perimeter around a portion of the metal sheet.

5. An apparatus according to claim 4, wherein the first binding surface comprises a seal bead having a porcelain enamel coating.

6. An apparatus according to claim 1, wherein the porcelain enamel coating is a borosilicate glass.

7. An apparatus according to claim 1, wherein the porcelain enamel coating is prepared from a composition comprising quartz, borax, boric acid, potassium nitrate, sodium silicofluoride, and manganese dioxide.

8. An apparatus according to claim 7, wherein the composition further includes a member selected from the group consisting of titanium dioxide, antimony oxide, cobalt oxide, barium oxide, and combinations thereof.

9. An apparatus according to claim 1, wherein the porcelain enamel coating is prepared from a composition comprising from about 39 to about 52 percent by weight quartz, from about 15 to about 24 percent by weight borax (on an anhydrous basis), from about 6 to about 12 percent by weight boric acid, from about 5 to about 8 percent by weight potassium nitrate, from about 3 to about 6 percent by weight sodium silicofluoride, and from about 3 to about 12 percent by weight manganese dioxide.

10. An apparatus according to claim 9, wherein the composition further includes a member selected from the group consisting of up to about 15 percent by weight titanium dioxide, up to about 3 percent by weight antimony oxide, up to about 1 percent by weight cobalt oxide;

up to about 1 percent by weight barium oxide, and combinations thereof.

11. An apparatus according to claim 1, wherein the porcelain enamel coating is prepared from a composition comprising from about 39 to about 52 percent by weight quartz, from about 15 to about 24 percent by weight borax (on an anhydrous basis), from about 7 to about 12 percent by weight boric acid, from about 5 to about 8 percent by weight potassium nitrate, from about 3 to about 8 percent by weight sodium silicofluoride, and from about 3 to about 12 percent by weight manganese dioxide.

12. An apparatus according to claim 11, wherein the composition further includes a member selected from the group consisting of up to about 12 percent by weight titanium dioxide, up to about 8 percent by weight antimony oxide, up to about 1 percent by weight cobalt oxide, up to about 1 percent by weight barium oxide, and combinations thereof.

13. An apparatus according to claim 1, wherein the porcelain enamel coating is prepared from a composition comprising about 46.5 percent by weight quartz, about 21 percent by weight borax (on an anhydrous basis), about 7.5 percent by weight boric acid, about 6 percent by weight potassium nitrate, about 5 percent by weight sodium silicofluoride, about 11.5 percent by weight manganese dioxide, and about 2.5 percent by weight antimony oxide.

14. An apparatus according to claim 1, wherein the porcelain enamel coating has a softening point of about a maximum temperature for forming said metal.

15. An apparatus according to claim 1, wherein the porcelain enamel coating has a thermal expansion coefficient about equal to the thermal expansion coefficient of the part having the binding surface.

16. A forming tool for quick plastic forming or superplastic forming, comprising a seal bead, wherein said seal bead comprises an enamel coating.

17. A forming tool according to claim 16, wherein the porcelain enamel coating is a borosilicate glass.

18. A forming tool according to claim 16, wherein the porcelain enamel coating is prepared from a composition comprising quartz, borax, boric acid, potassium nitrate, sodium silicofluoride, and manganese dioxide.

19. A forming tool according to claim 18, wherein the composition further includes a member selected from the group consisting of titanium dioxide, antimony oxide, cobalt oxide, barium oxide, and combinations thereof.

20. A forming tool according to claim 16, wherein the porcelain enamel coating is prepared from a composition comprising from about 39 to about 52 percent by weight quartz, from about 15 to about 24 percent by weight borax (on an anhydrous basis), from about 6 to about 12 percent by weight boric acid, from about 5 to about 8 percent by weight potassium nitrate, from about 3 to about 6 percent by weight sodium silicofluoride, and from about 3 to about 12 percent by weight manganese dioxide.

21. A forming tool according to claim 16, wherein the porcelain enamel coating has a softening point of about a maximum temperature for forming a desired metal with the superplastic forming tool.

22. A method of forming a metal sheet, comprising gripping the metal sheet between complementary tool surfaces and heating the metal sheet, wherein at least one of said complementary surfaces comprises an enamel coating.

23. A method according to claim 22, wherein both of said complementary surfaces comprise an enamel coating.

24. A method according to claim 22, wherein the metal sheet comprises an aluminum alloy.

25. A method according to claim 22, comprising a further step of forming the metal sheet into a desired shape by quick plastic forming or super plastic forming.

26. A method according to claim 25, wherein the porcelain enamel coating is a borosilicate glass.

27. A method according to claim 25, wherein the porcelain enamel coating is prepared from a composition comprising from about 39 to about 52 percent by weight quartz, from about 15 to about 24 percent by weight borax (on an anhydrous basis), from about 6 to about 12 percent by weight boric acid, from about 5 to about 8 percent by weight potassium nitrate, from about 3 to about 6 percent by weight sodium silicofluoride, and from about 3 to about 12 percent by weight manganese dioxide.

28. A method according to claim 25, wherein the porcelain enamel coating has a softening point of about a maximum temperature at which the metal sheet is formed into the desired shape.

* * * * *